US008174353B2

(12) United States Patent
Jeong et al.

(10) Patent No.: US 8,174,353 B2
(45) Date of Patent: May 8, 2012

(54) VARISTOR AND VARISTOR APPARATUS

(75) Inventors: Tae-Hoon Jeong, Gunpo-si (KR); Kyo-Sung Ji, Suwon (KR); Jung-Soo Kim, Gunpo-si (KR); Jung-Hwan Kim, Ansan-si (KR); Sung-Wook Choi, Bucheon-si (KR)

(73) Assignees: Samhyun CNS Co., Ltd., Gyeonggi-Do (KR); Jung-Soo Kim, Gyeonggi-Do (KR)

( * ) Notice: Subject to any disclaimer, the term of this patent is extended or adjusted under 35 U.S.C. 154(b) by 878 days.

(21) Appl. No.: 12/235,437

(22) Filed: Sep. 22, 2008

(65) Prior Publication Data

US 2009/0079535 A1 Mar. 26, 2009

(30) Foreign Application Priority Data

Sep. 21, 2007 (KR) ..... 10-2007-0096522
Sep. 21, 2007 (KR) ..... 10-2007-0096523
Oct. 16, 2007 (KR) ..... 10-2007-0104045
Jun. 18, 2008 (KR) ..... 10-2008-0057183

(51) Int. Cl.
*H01C 7/10* (2006.01)

(52) U.S. Cl. ..... 338/21; 338/20; 361/124

(58) Field of Classification Search ..... 338/20, 338/21, 22 R; 361/124, 118, 127; 337/197, 337/198, 216
See application file for complete search history.

(56) References Cited

U.S. PATENT DOCUMENTS 5,760,336 A * 6/1998 Wang ..... 174/535
5,945,903 A * 8/1999 Reddy et al. ..... 337/197
6,094,128 A * 7/2000 Bennett et al. ..... 338/21
6,188,307 B1 * 2/2001 Katsuki et al. ..... 338/22 R
6,430,019 B1 * 8/2002 Martenson et al. ..... 361/124

FOREIGN PATENT DOCUMENTS

KR 10-2004-0015367 1/2003
KR 1020070053016 5/2007

* cited by examiner

*Primary Examiner* — Kyung Lee
(74) *Attorney, Agent, or Firm* — IPLA P.A.; James E. Bame

(57) ABSTRACT

A varistor comprises a main body having first and second external terminals formed on the outer surface thereof, a first withdrawn terminal plate joined to the first external terminal, and a second withdrawn terminal plate joined to the second external terminal, wherein the melting point of a second bonding material for allowing the second withdrawn terminal plate and the second external terminal to be joined to each other is lower than that of a first bonding material for allowing the first withdrawn terminal plate and the first external terminal to be joined to each other.

12 Claims, 8 Drawing Sheets

VARISTOR AND VARISTOR APPARATUS

CROSS REFERENCES

Applicant claims foreign priority under Paris Convention and 35 U.S.C. §119 to Korean Patent Application Nos. 10-2007-0096522 filed 21 Sep. 2007, 10-2007-0096523 filed 21 Sep. 2008, 10-2007-0104045 filed 16 Oct. 2007, and 10-2008-0057183 filed 18 Jun. 2008, each with the Korean Intellectual Property Office, where the entire contents are incorporated herein by reference.

BACKGROUND OF THE INVENTION

1. Field of the Invention

The present invention relates to a varistor which prevents the short-circuiting phenomena occurring due to the close contact of a terminal and a main body by any re-contact therebetween upon the separation of the terminal from the main body by means of a surge having a mere than a threshold current capacity.

2. Background Art

A varistor is a device that prevents the burnout or damage of electric or electronic equipment by the surge due to a thunderstroke or switching surges due to the operation of relays. If a surge of more than an absorbing current capacity is introduced into the electric or electronic equipment, the varistor is burnt out. Also, if a normal power is applied to the electric or electronic equipment in a state where the varistor is burnt out, the varistor is operated as a low-resistance load to cause a short-circuiting accident to occur.

In order to prevent such a short-circuiting accident, there has been developed a thermo cutoff varistor taught in Korean Utility Model Registration No. 20-0267634. However, such a thermo cutoff varistor entails a problem in that it deteriorates the surge limiting voltage characteristics of the varistor, such that even when a surge of less than an absorbing current capacity is introduced into the electric or electronic equipment, it is difficult to perform a normal operation of the varistor.

SUMMARY OF THE INVENTION

Accordingly, the present invention has been made in an effort to solve the aforementioned problems occurring in the prior art, and it is an object of the present invention to provide a varistor which ameliorates a surge limiting voltage characteristics thereof at the time of introduction of a surge of less than an absorbing current capacity, and prevents a short-circuiting phenomenon at the time of introduction of a surge of more than an absorbing current capacity.

Another object of the present invention is to provide a varistor in which when a surge of more than an absorbing current capacity is introduced into the varistor to cause the inside of the varistor to be deformed, it is possible to externally recognize it.

To accomplish the above object, according to a first embodiment of the present invention, there is provided a varistor comprising a main body having first and second external terminals formed on the outer surface thereof, a first withdrawn terminal plate joined to the first external terminal, and a second withdrawn terminal plate joined to the second external terminal, wherein the melting point of a second bonding material for allowing the second withdrawn terminal plate and the second external terminal to be joined to each other is lower than that of a first bonding material for allowing the first withdrawn terminal plate and the first external terminal to be joined to each other.

According to a second embodiment of the present invention, there is provided a varistor apparatus comprising a varistor and a housing for accommodating the varistor therein, wherein the varistor comprises a main body having a front electrode plate and a rear electrode plate formed on the outer surface thereof, a plate-shaped withdrawn terminal joined to the front electrode plate, and a plate-shaped resilient withdrawn terminal jointed to the rear electrode plate, wherein the housing has a plurality of through-holes formed thereon so as to allow the withdrawn terminal and the resilient withdrawn terminal to be withdrawn to the outside, and has a projecting support formed thereon so as to be in close contact with the resilient withdrawn terminal so that an external force is applied to the joined portion between the resilient withdrawn terminal and the rear electrode plate in a direction where the resilient withdrawn terminal is separated from the rear electrode plate, and wherein the melting point of a bonding material for allowing the front electrode plate and the withdrawn terminal plate to be joined to each other is higher than that of a bonding material for allowing the rear electrode plate and the resilient withdrawn terminal plate to be joined to each other.

According to a third embodiment of the present invention, there is provided a varistor apparatus comprising: a base case including a bottom and lateral walls bent upwardly from the edges of the bottom; a varistor including a main body, a front electrode plate welded to a front surface of the main body, and a rear electrode plate welded to a rear surface of the main body, the rear electrode plate being disposed adjacent to the bottom of the base case; a front terminal member projected at one end thereof to the outside of the base case and disposed at the other end thereof inside the base case; a rear terminal member projected at one end thereof to the outside of the base case and disposed at the other end thereof inside the base case so as to joined to the rear electrode plate; a tension bar joined at one end thereof to the other end of the front terminal member and thermally welded at the other end thereof to the front electrode plate, the tension bar having a restoring force for allowing the other end of the tension bar to be far away from the front electrode plate; and a cover case joined to the base case.

According to a fourth embodiment of the present invention, there is provided a varistor apparatus comprising: a housing; a varistor accommodated in the housing; a first withdrawn terminal plate joined at one end thereof to one side of the varistor by means of a first bonding material having a first melting point; a second withdrawn terminal plate joined at one end thereof to the other side of the varistor by means of a second bonding material having a second melting point lower than the first melting point, wherein the first withdrawn terminal plate and the second withdrawn terminal plate are projected at the other ends thereof to the outside of the housing, and the second withdrawn terminal plate includes a resilient portion formed inclinedly between the one end and the other end thereof having a restoring force acting in a direction of going far away from the other side of the varistor; a slider fit at one end thereof to a rotary shaft protruded from the inside of the housing so as to be rotated about the rotary shaft, the slider having a base portion inserted in a space defined by the other side of the varistor and the second withdrawn terminal plate; and a spring connected at a starting end to the slider and connected at a terminating end to the housing in such a fashion as to have a restoring force so as to be compressed, whereby when the one end of the second withdrawn terminal plate is separated from the other side of the varistor, the slider is rotated by means of the restoring force of the spring to cause the slider to be interposed between the one end of the second withdrawn terminal plate and the other side of the varistor to thereby prevent a short-circuiting.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION

Figure 1:
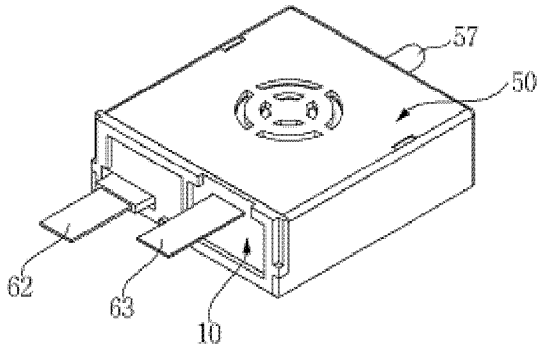
FIG. 1 is a perspective view illustrating a first embodiment of the present invention.

Reference will now be made in detail to the preferred embodiment of the present invention, examples of which are illustrated in the drawings attached hereinafter, wherein like reference numerals refer to like elements throughout. The embodiments are described below so as to explain the present invention by referring to the figures.

Now, a first embodiment of the present invention will be described in detail hereinafter with reference to FIGS. 1 to 3.

Figure 2:
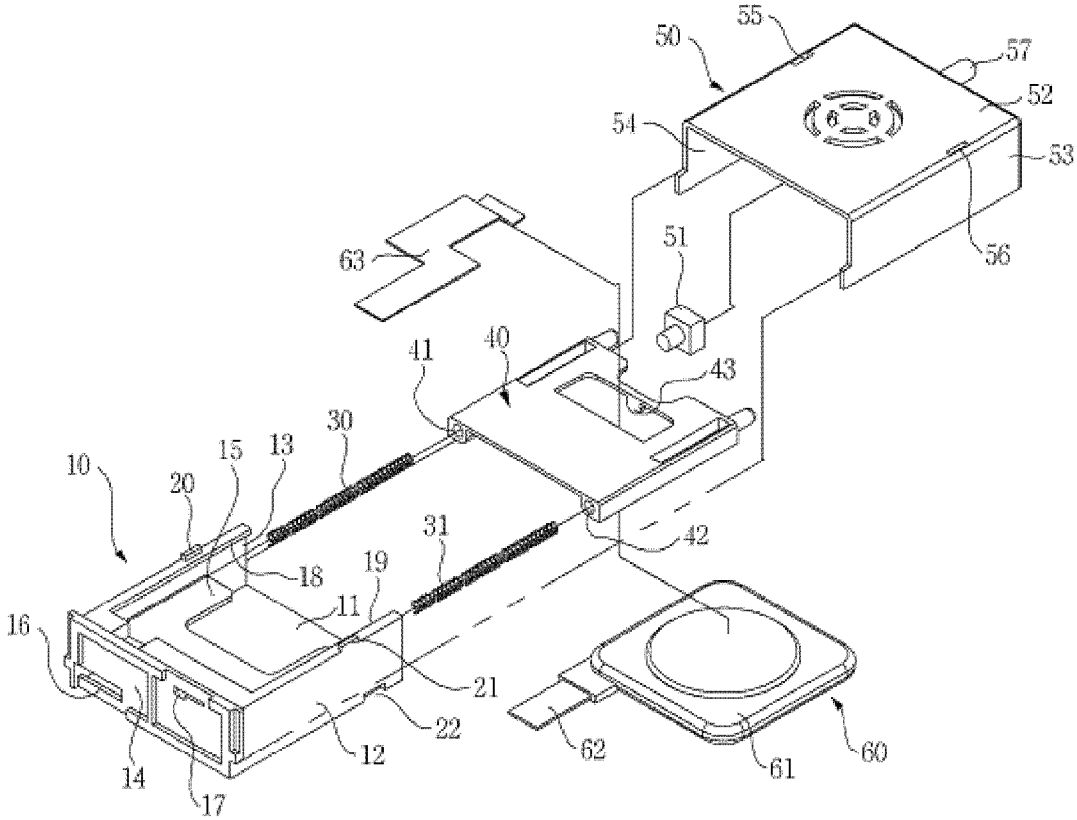
FIG. 2 is an exploded perspective view of FIG. 1.
Figure 3:
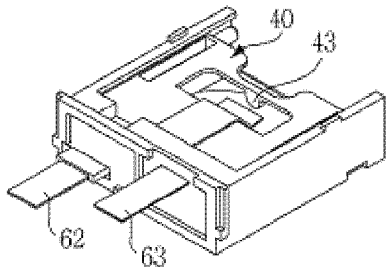
FIG. 3 is an assembled perspective view illustrating a lower case and a varistor according to a first embodiment of the present invention.

As shown in FIGS. 1 to 3, a lower case 10 includes both lateral walls 12 and 13 bent upwardly vertically from both side edges of a bottom 11 formed of a square-shaped plate, a front wall 14 bent upwardly vertically from a front edge of the bottom and perpendicularly meeting front ends of the both lateral walls 12 and 13 at both lateral ends thereof, and a partition plate 15 mounted to the inner surface of the both lateral walls 12 and 13 in such a fashion as to be positioned at a given height from the bottom and in parallel with the bottom 11.

In this case, a front end of the partition plate 15 is perpendicularly bonded to the front wall 14, and the length running from the front end to a rear end of the partition plate 15 is smaller than the distance between the both lateral walls 12 and 13. The central portion of the rear end of the partition plate 15 has a "⊂"-shaped groove formed inwardly toward the front end of the partition plate.

Also, the both lateral walls 12 and 13 have guide portions 18 and 19 bent inwardly from the top ends thereof. The guide portions 18 and 19 have coupling protrusions 20 and 21 formed thereon so as to be fit into through-holes 55 and 56 of an upper case 50 which will be described later. On the contrary, the both lateral walls 12 and 13 have grooves 22 formed on the bottom surfaces thereof so as to allow coupling protrusions of the upper case 50 to be fit thereto.

In addition, the front wall 14 has elongated slits 16 and 17 formed penetratingly thereon in parallel with a top edge thereof. The elongated slit 16 is formed in the proximity of the bottom edges of the lateral wall 13 and the front wall 14, and the elongated slit 17 is formed in the proximity of the top edges of the lateral wall 12 and the front wall 14.

Further, the front wall 14 has a pair of projecting pins (not shown) formed on a rear surface thereof so as to allow one ends of springs 30 and 31 to be fit around one ends of the projecting pins.

A slider 40 is formed in a plate shape and has two opposed spring insertion holes 41 and 42 formed in both lateral ends thereof so as to allow the other ends of the springs 30 and 31 to be inserted thereto. The slider 40 is moved forwardly or rearwardly on the partition plate 15 by means of a restoring force of the spring 30 and 31.

Also, the slider 40 has a rectangular opening formed adjacent to a rear end thereof and a protrusion 43 formed downwardly vertically on an underside thereof between the opening and the rear end thereof so that when the slider 40 is moved forwardly or rearwardly, the protrusion 43 causes a switch which will be described later to be operated.

A varistor 60 has metal oxides and internal terminals stacked therein. The varistor 60 includes a main body 61 having a pair of external terminals formed on both outer surfaces thereof, a first withdrawn terminal plate 62 coupled at one end thereof to one of the pair of the external terminals, and a second withdrawn terminal plate 63 coupled at one end thereof to the other of the pair of the external terminals. In this case, the first withdrawn terminal plate 62 and one of the external terminals are bonded to each other by means of lead having a melting point of 270° C., and the second withdrawn terminal plate 63 and the other of the external terminals are bonded to each other by means of a bonding material in which impurities are added to lead to have a melting point ranging from 100° C. to 200° C. Also, the second withdrawn terminal plate 63 is formed of a plate-shaped member having resiliency in such a fashion that it has a sloping face whose front end is joined to the external terminal and whose rear end is formed with a flexible extending portion formed in parallel with the partition plate in such a fashion as to be spaced apart from the partition plate. Thus, when the varistor main body 61 is heated due to introduction of a surge of more than an absorbing current capacity, the second withdrawn terminal plate 63 is earlier separated from the main body 61 than first withdrawn terminal plate 62. Thereafter, in case where the other end of the second withdrawn terminal plate is fixed to a housing by means of a resilient force of the second withdrawn terminal plate 63, it is required that an additional close contact between the second withdrawn terminal plate and the main body of the varistor be prevented.

If the melting point of the bonding material for the second withdrawn terminal plate 63 is less than 100° C., the second withdrawn terminal plate may be separated from the external terminal in a state where the second withdrawn terminal plate is heated by a surge of less than an absorbing current capacity.

On the other hand, if the melting point of the bonding material for the second withdrawn terminal plate 63 is more than 200° C., the second withdrawn terminal plate and the first withdrawn terminal plate 62 may be simultaneously separated from the external terminals.

In the meantime, an upper case 50 includes a top 52 opposite to the bottom 11 of the lower case 10, both lateral walls 53 and 54 bent upwardly vertically from both side edges of the top so as to abut against the outer surfaces of the both lateral walls 12 and 13 of the lower case, and a rear wall bent downwardly vertically from a rear edge of the top of the upper case.

In addition, the top 52 of the upper case 50 has a contact switch 51 mounted on the underside thereof. The contact switch 51 performs a switching operation through a contact with or a separation from the protrusion 43 of the slider 40. Also, an LED 57 is rearwardly mounted to the rear wall of the upper case, and is turned on or off by the contact switch 51. Also, the top 42 has through-holes 55 and 56 formed thereon in the proximity of the top edges of the both lateral walls 53 and 54, so that when the lower case 10 and the upper case 50 are assembled to each other, the coupling protrusions 20 and 21 of the lower case 10 are fit into the through-holes 55 and 56. The both lateral walls 53 and 54 have coupling protrusions formed on the inner surfaces thereof so as to be retainingly fit into the grooves 22 formed on the bottom surfaces of the both lateral walls 12 and 13 of the lower case 10.

Further, the top 52 has a plurality of through-holes formed at the central portion thereof so as to externally emit heat generated from the varistor 62.

The assembly process of the varistor according to the first embodiment of the present invention will be described hereinafter.

First, the first withdrawn terminal plate 62 is joined to the varistor main body 61 and then the main body 61 is seated in a space defined between the partition plate 15 and the bottom 11. Then, the first withdrawn terminal plate 62 is protrudingly mounted in such a fashion as to be pass through the elongated slit 16, and one ends of the springs 30 and 31 are fit around the projecting pins formed at the rear surface of the front wall 14 of the lower case. Thereafter, the other ends of the springs 30 and 31 are inserted into spring insertion holes 41 and 42 of the slider 40 and then the slider 40 is disposed on the partition plate 15 so as to be moved forwardly or rearwardly while abutting against the partition plate 15. In a state where the slider 40 is disposed on the partition plate 15, the sloping face of the second withdrawn terminal plate 63 passes through the rectangular opening of the slider 40 and then the front end of the sloping face is bonded to the external terminal of the main body 61 by a melting a bonding material. Then, the rear end of the sloping face of the second withdrawn terminal plate 63 passes through the elongated slit 17 so as to be projected externally. At this time, the sloping face of the second withdrawn terminal plate 63 is in close contact with an end defining the opening of the slider 40, and the rear end of the sloping face of the second withdrawn terminal plate 63 is positioned on the top surface of the slider 40 as a result that the second withdrawn terminal plate 63 is assembled to the lower case as shown in FIG. 3. In this case, the upper case 50 is finally assembled to the lower case 10.

In the first embodiment, when a surge of more than a threshold current capacity is introduced into the varistor 60, the second withdrawn terminal plate 63 is separated from the external terminal since the bonding material is melt. At this time, a resilient force is applied to the second withdrawn terminal plate 63 by means of the slider 40 which is bound resiliently by the springs 30 and 31, so that a distance between the second withdrawn terminal plate 63 and the external terminal is made large. If the distance between the second withdrawn terminal plate 63 and the external terminal is made large, the springs 30 and 31 compressed inside the slider 40 is stretched so that the slider 40 is moved rearwardly so as to serve as a separation plate between the second withdrawn terminal plate 63 and the external terminal to thereby prevent any re-contact between the second withdrawn terminal plate 63 and the external terminal.

Therefore, any short-circuiting accident due to an incomplete contact between the second withdrawn terminal plate 63 and the external terminal can be prevented.

In addition, as the slider 40 is moved rearwardly, the protrusion 43 of the slider 40 activates the contact switch 51 to cause the LED 50 to be turned on, and a manager checks the lighting of the LED and then can replace a failed varistor with new one.

Now, a second embodiment of the present invention will be described in detail hereinafter with reference to FIGS. 4 and 5.

Figure 4:
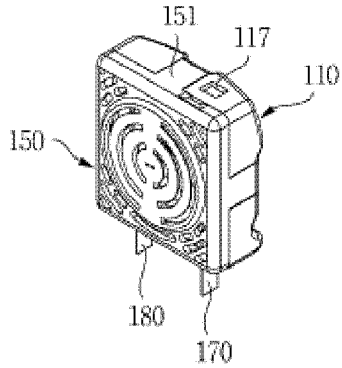
FIG. 4 is a perspective view illustrating a second embodiment of the present invention.
Figure 5:
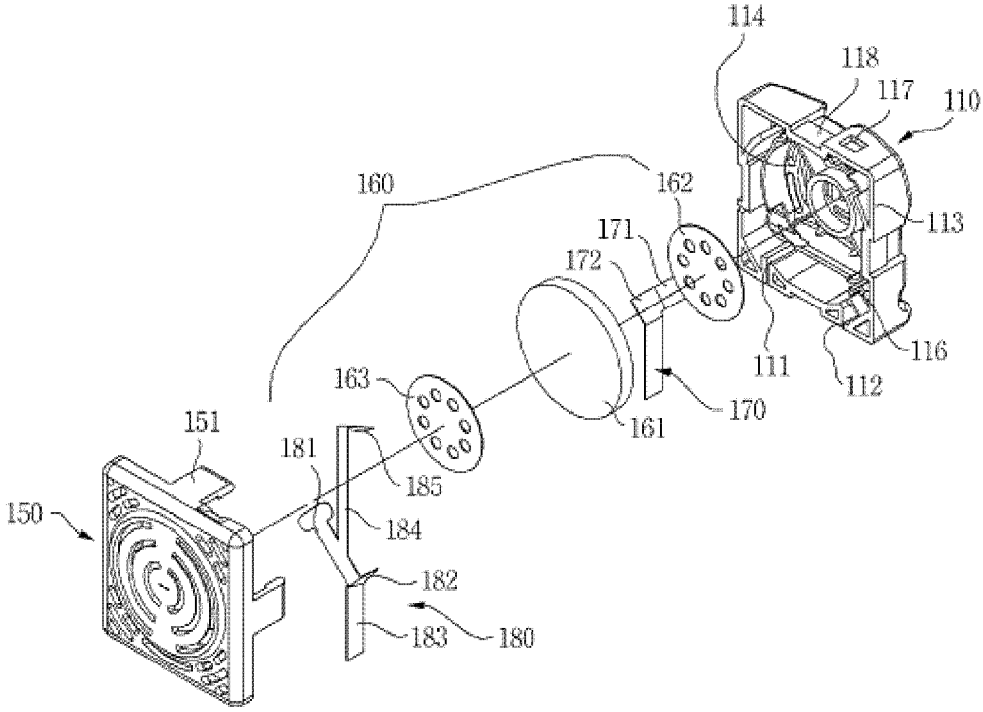
FIG. 5 is an exploded perspective view of FIG. 4.

As shown in FIGS. 4 and 5, a housing includes a base case 110 and a cover case 150 coupled to the base case so as to internally define an installation space to install a varistor 160.

Also, as shown in FIG. 5, the varistor 160 includes a main body 161 in which a pair of disc-like electrode plates 162 and 163 are soldered onto both outer surfaces of a stacked body in which a metal oxide is stacked on an internal terminal mounted therein, a withdrawn terminal 170 joined to a front electrode plate 162, a resilient withdrawn terminal 180 joined to a rear electrode plate 163. In this case, a portion of the varistor 160 in which the resilient withdrawn terminal 180 is not joined to the rear electrode plate 163 is coated with an insulating material except the joining portion between the rear electrode plate 163 and the resilient withdrawn terminal 180. The coated varistor 160 is mounted inside the base case 110.

The withdrawn terminal 170 is a plate-shaped member having a predetermined width, and includes a joining portion 171 bonded to the front electrode plate 162 of the varistor by means of soldering, an extending portion 172 bent perpendicularly from the joining portion 171, and a withdrawn portion 173 extending downwardly from the extending portion 172 in such a fashion as to be inclined at a given angle. The withdrawn portion 173 is fixedly fit into an incised slit 111 of the base case 110 in such a fashion that its end is projected to the outside of the base case 110.

Further, the joining portion 171 of the withdrawn terminal 170 is soldered to the front electrode plate 162 by means of lead.

Moreover, the resilient withdrawn terminal 180 formed of a sheet having resiliency includes a joining portion 181 boned at one end thereof to the rear electrode plate 163, a bent portion 182 bent perpendicularly from the other end of the joining portion 181, a withdrawn portion 183 extending downwardly from one side of the bent portion 182 in such a fashion as to be bent at an obtuse angle, a branched portion 184 branched off between the one end of the other end of the joining portion 181 in such a fashion that the branched portion forms an acute angle with the joining portion, and an indicating portion 185 bent from a distal end of the branched portion 184. In this case, the withdrawn portion 183 is fixedly fit into an incised slit 112 of the base case 110 in such a fashion that its end is projected to the outside of the base case 110. Also, one end of the joining portion 181 of the resilient withdrawn terminal 180 is joined to the rear electrode plate 163 by means of a bonding material having a melting point lower than that of lead.

The base case 110 includes a square-shaped bottom 114, four lateral walls 113 each bent from each edge of the bottom, and an inner wall 115 formed in an arc shape having a given length at the inside of the base case in such a fashion as to be spaced apart from the lateral wall 113. A part of the lateral wall 113, i.e., a lower lateral wall as shown in FIG. 4 has two incised slits 111 and 112 formed thereon, and the base case has a circular inner wall 115 formed therein so as to allow the main body 161 to be seated therein. The varistor main body 161 is seated in a space defined by the inner wall 115 and the bottom 114, and the withdrawn terminal 170 joined to the varistor main body 161 is fit into the incised slit 111.

In addition, a projecting support 116 projecting from the bottom 114 is formed in the proximity of the incised slit 112, and a top end of the projecting support 116 comes into close contact with the joining portion 181 of the resilient withdrawn terminal 180 so as to exert an external force to the joining portion 181 to generate a resilient force.

When a varistor main body 160 to which the resilient withdrawn terminal 180 is not joined is mounted inside the base case 110, the withdrawn portion 183 of the resilient withdrawn terminal 180 is fit into the incised slit 112 and the resilient withdrawn terminal 180 is joined to the main body 160 by melting a bonding material to one end of the joining portion 181 and the rear electrode plate 163 in a state where the external force is exerted to the joining portion 181.

In case where a surge of more than a threshold current capacity is applied between the withdrawn terminal 170 and the resilient withdrawn terminal 180, since the resilient withdrawn terminal 180 is joined to the rear electrode plate by means of a bonding material having a low melting point, it is earlier separated from the main body 161 than the withdrawn terminal 170 and one end of the joining portion 181 of the resilient withdrawn terminal 180 is applied with a resilient force in a separation direction of the resilient withdrawn terminal 180. At this time, since the resilient force is greatly acted by the projecting support 116, a separated distance between the resilient withdrawn terminal 180 and the main body 161 is greatly increased upon the melting of the bonding material to thereby prevent any re-contact between the resilient withdrawn terminal 180 and the main body 161.

Also, each of the four lateral walls 113 of the base case 110 includes a concaved groove 118 formed on the central portion of the outer surface thereof. The concaved groove is formed with a stepped portion. Thus, retaining portions 151 of the cover case 150 are resiliently supported in the concaved grooves 118 and retaining steps formed at free ends of the retaining portions 151 are retained by the stepped portions so as to join the base case 110 and the cover case 150 to each other.

In addition, the lateral wall 113 has a through-hole 117 formed on a side thereof to correspond to the indicating portion 185 of the resilient withdrawn terminal 180 so as to view the indicating portion 185 inside the base case. In case where the joining portion 181 of the resilient withdrawn terminal 180 is normally joined to the rear electrode plate 163, the indicating portion 185 is viewed through the through-hole 117 in a state where the joining portion 181 is bent. On the contrary, in case where the joining portion 181 of the resilient withdrawn terminal 180 is separated from the rear electrode plate 163, since the joining portion 181 is returned to its original state by means of a restoring force in a state where the joining portion 181 is not bent, the indicating portion 185 is moved. Thus, the indicating portion 185 is not viewed through the through-hole 117. Therefore, a user can check the joined state of the joining portion 181 through the through-hole 117, i.e., whether the varistor is normally operated.

Further, the bottom of the base case 110 and the base surface of the cover case 150 have a plurality of through-holes formed thereon so as to externally emit gas and heat generated from the inside of the housing.

Now, a third embodiment of the present invention will be described in detail hereinafter with reference to FIGS. 6 to 10.

Figure 6:
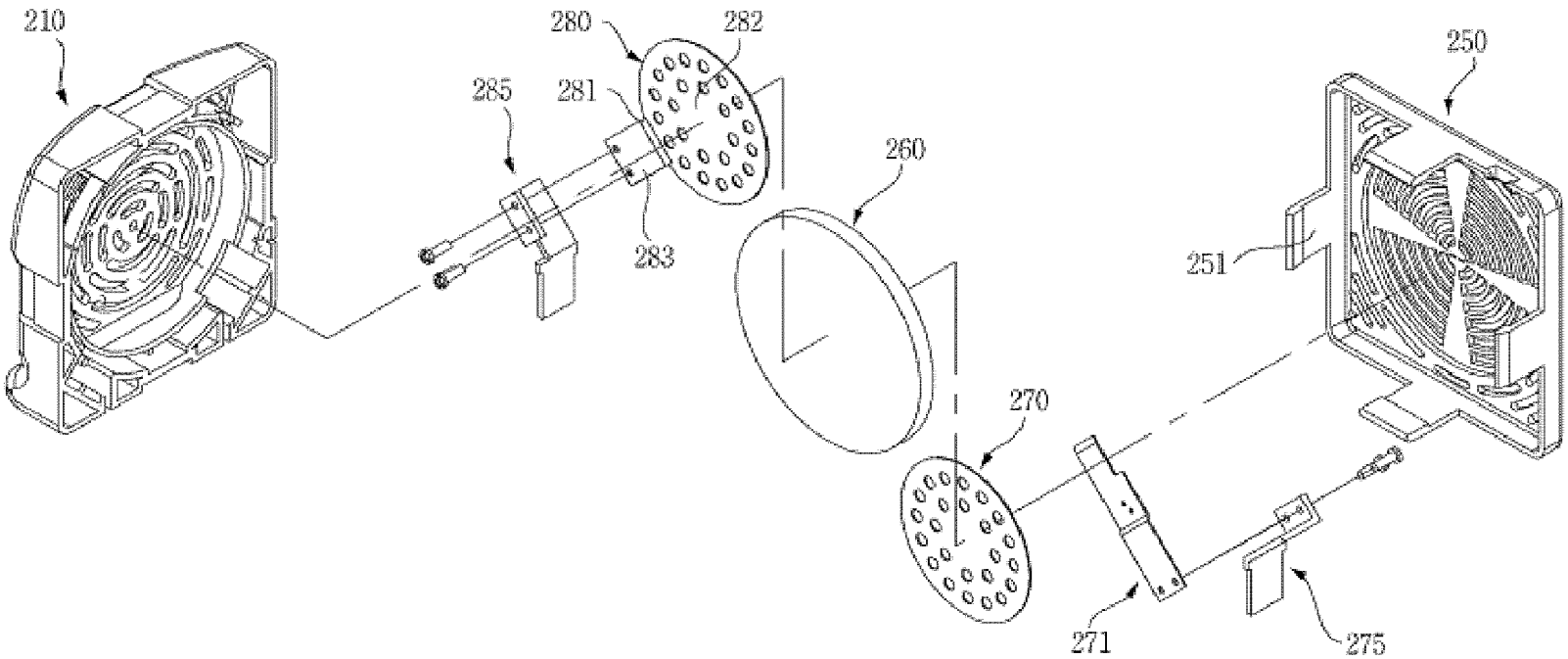
FIG. 6 is an exploded perspective view illustrating a third embodiment of the present invention.
Figure 7:
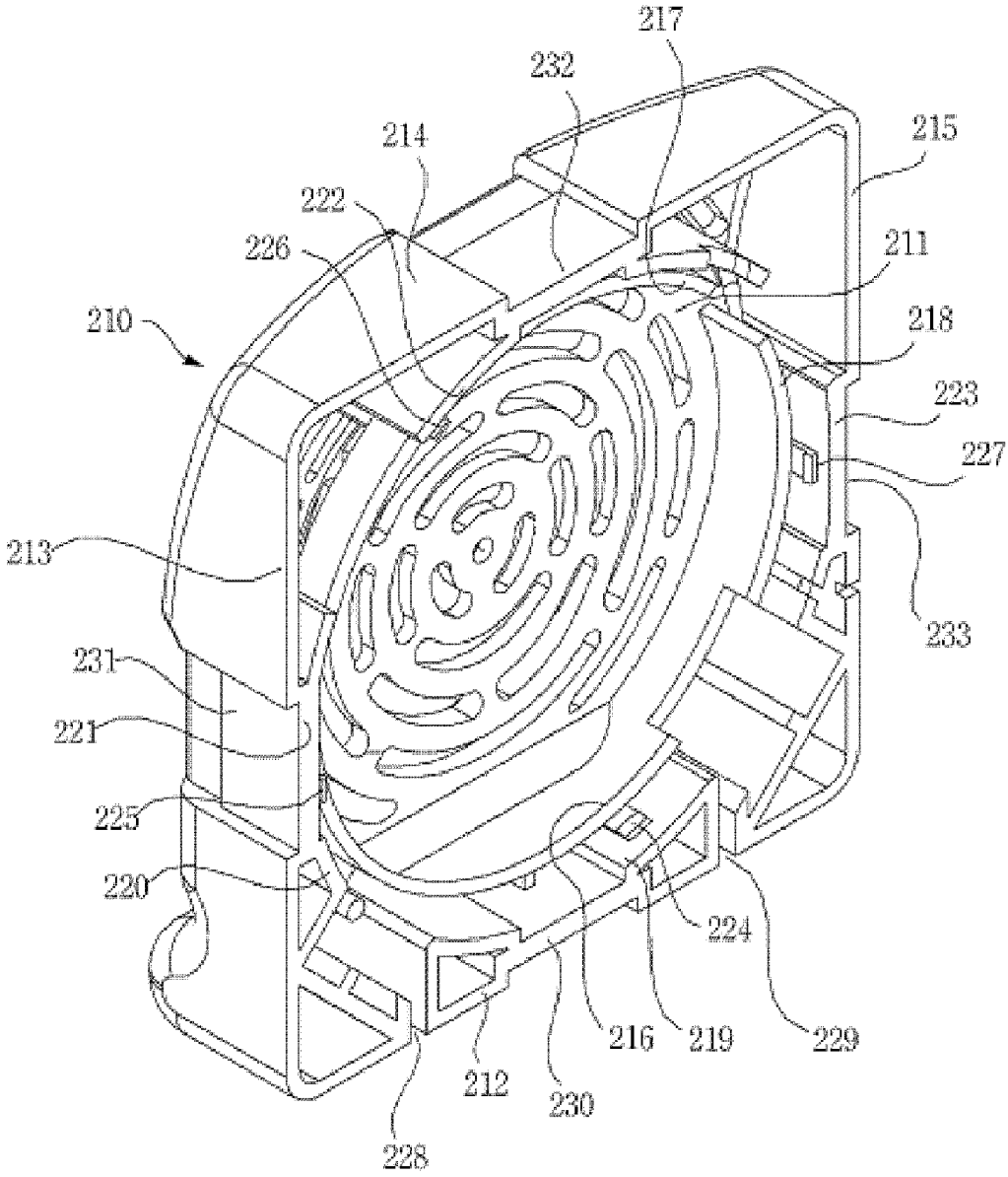
FIG. 7 is a perspective view illustrating a base according to the third embodiment of the present invention.

As shown in FIGS. 6 and 7, a varistor includes a disc-like main body 260 having an internal electrode mounted therein and formed of a metal oxide, a front electrode plate 270 welded to a front surface of the main body 260, and a rear electrode plate 280 welded to a rear surface of the main body 260. The front and rear surfaces of the main body 260 is subjected to silver plating so as to promote a bonding operation during the soldering.

In addition, the front electrode plate 270 is a metal plate having a diameter smaller than that of the main body 260 and has a plurality of circular through-holes thereon so as to allow gas generated from the main body 260 to be discharged to the outside and increase a bonding force of the front electrode plate 270 and the main body 260 during the soldering.

Further, the rear electrode plate 280 is a metal plate 282 having a diameter smaller than that of the main body 260 and has a plurality of circular through-holes formed thereon. The rear electrode plate 280 includes a bent portion 282 bent integrally from a part of the circumferential surface thereof and a resilient plate 283 re-bent from an end of the bent portion 281 and extending in parallel with the metal plate 282.

Such a varistor is mounted in an inner space of a base case 210. The base case 210 includes a square-shaped bottom 211, and lateral wall 212, 213, 214 and 215 bent vertically from each edge of the bottom 211.

The bottom 211 has inner support walls 216, 217 and 218 protrudingly formed concentrically thereon so as to allow the rear surface of the varistor to be seated on the top surface thereof. The inner support walls have three incised portions and a predetermined height. Also, the bottom 211 has a plurality of fixing portions 219, 220, 221, 222 and 223 formed concentrically thereon so as to allow the inner circumference thereof to abut against the outer circumference of the varistor. The fixing portions have retaining steps formed inwardly on upper ends thereof and resilient retaining portions 224, 225, 226 and 227 formed inwardly so as to act a resilient force, such that a top surface adjacent to the outer circumference of the varistor is retained by the retaining steps so as to suppress any movement of the varistor.

Also, the lateral wall 212 has two incised slits 228 and 229 formed thereon so as to allow terminal members which will be described later to be fit thereto, and has a support structure formed inwardly from the incised slits 228 and 229 so as to support the terminal members fit into the incised slits.

Figure 8:
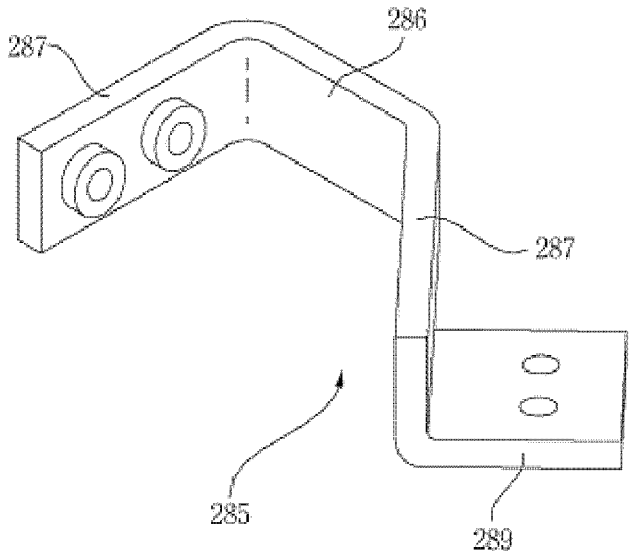
FIG. 8 is a perspective view illustrating a rear terminal member according to the third embodiment of the present invention.

As shown in FIG. 8, a rear terminal member 285 includes an inserting portion 286 inserted into the incised slit 229, an externally extending portion 287 bent perpendicularly outwardly from one end of the inserting portion 286, an internally extending portion 288 bent inclinedly from the other end of the inserting portion 286, and a joining portion 289 bent perpendicularly from the bottom surface of the internally extending portion 288. In this case, the externally extending portion 287 has through-holes formed therein so as to withdraw an external wire therethrough, and the joining portion 289 has screw holes formed thereon so as to be screw-engaged with the resilient plate 283 of the rear electrode plate 280 therethrough.

Figure 9:
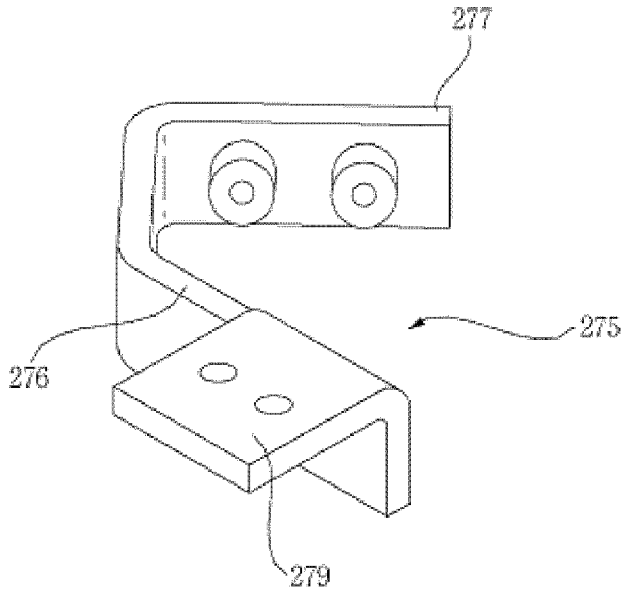
FIG. 9 is a perspective view illustrating a front terminal member according to the third embodiment of the present invention.

As shown in FIG. 9, a front terminal member 275 includes an inserting portion 276 inserted into the incised slit 228, an externally extending portion 277 bent perpendicularly outwardly from one end of the inserting portion 276, an internally extending portion 278 bent inclinedly from the other end of the inserting portion 276, and a joining portion 279 bent perpendicularly from the top surface of the internally extending portion 278. In this case, the externally extending portion 277 has through-holes formed therein so as to withdraw an external wire therethrough, and the joining portion 279 has screw holes formed thereon so as to be screw-engaged with the tension bar 271 therethrough.

Figure 10:
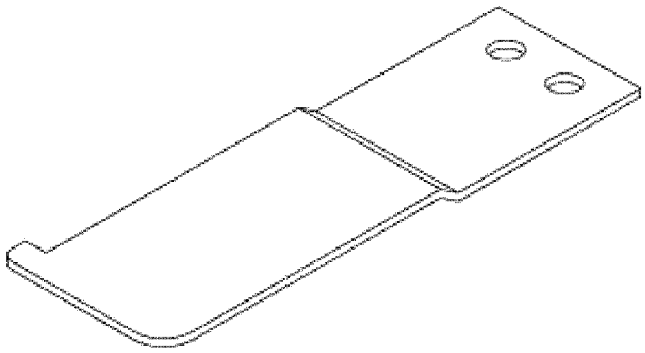
FIG. 10 is a perspective view illustrating a tension bar according to the third embodiment of the present invention.

As shown in FIG. 10, the tension bar 271 is joined at one end thereof to the joining portion 279 of the front terminal member and is thermally welded at the other end thereof to the front electrode plate 270 by means of a metal bonding material having a melting point lower than that of lead. In this case, the tension bar 271 has a bent portion formed between one end and the other end thereof, so that when an external force is downwardly exerted to the other end of the tension bar to cause displacement of the tension bar to occur, a restoring force is generated upwardly. In this case, the position where one end of the tension bar 271 and the joining portion 279 are joined to each other is set to be higher than the varistor, the other end of the tension bar is welded to the front surface of the varistor. The tension bar 271 is a resilient body having a restoring force, and thus when a welded portion of the tension bar 271 is melted, the tension bar is resiliently bounded and the other end of the tension bar is separated from the front surface of the varistor.

Also, the lateral walls 212, 213, 214 and 215 have grooves 230, 231, 232 and 233 formed at the central portion thereof, and each groove has a stepped portion formed at an intermediate portion thereof.

Further, the cover case 250 has retaining portions 251 formed protrudingly perpendicularly from each edge thereof, and the retaining portions have retaining steps projected from the inner surface thereof so as to be detachably retained by the grooves formed on the lateral walls.

In addition, the bottoms of the cover case and the base case have a plurality of through-holes formed thereon so as to externally discharge gas generated from the inside of the housing upon the introduction of a surge into the varistor.

Now, the assembly process of the varistor according to the third embodiment of the present invention will be described hereinafter.

The front electrode plate 270 is welded to the front surface of the main body 260, and the rear electrode plate 280 is welded to the rear surface of the main body to prepare a varistor.

The externally extending portion 287 of the rear terminal member 285 is disposed at the outer side of the lateral wall 212, and the inserting portion 286 is inserted into the incised slit 229 so that the joining portion 289 is positioned adjacent to the bottom 211 inside the lateral wall 2120.

The rear terminal member 285 is mounted in the base case 210, and then the rear surface of the varistor is seated on the top surface of the inner support walls 216, 217 and 218 and the front surface of the varistor is disposed so to be retained by the resilient retaining portions 224, 225, 226 and 227. Thereafter, the joining portion 289 of the rear terminal member 285 and the resilient plate 283 of the rear electrode plate 280 are engaged with each other by means of screws.

The tension bar 271 and the joining portion 279 of the front terminal member 275 are engaged with each other by means of screws, and then the externally extending portion 277 of the front terminal member 275 is disposed at the outer surface of the lateral wall 212. Then, the inserting portion 276 is inserted into the incised slit 228 so that the other end of the joined tension bar 271 is positioned at the center of the front surface of the varistor.

After an external force is exerted to the other end of the tension bar 271 to cause the tension bar to come into close contact with the front electrode plate 270, the other end of the tension bar is bonded to the front electrode plate 270 by means of a bonding material having a low melting point. At this time, the melting point of the bonding material having the low melting point is lower than that of a bonding material by which the rear electrode plate 280 and the rear surface of the main body are bonded to each other so that when the main body 260 of the varistor is heated, the bonding material having the low melting point is earlier melted than the bonding material by which the rear electrode plate 280 and the rear surface of the main body are bonded.

Also, the tension bar 271 is bonded to the front electrode plate by means of a metal bonding material having a low melting point, and a restoring force is acted on the tension bar in an upward direction, so that when the main body 260 is heated to cause the metal bonding material having a low melting point to be melted, the other end of the tension bar 271 is easily separated from the front surface of the varistor main body to thereby prevent a short-circuiting accident without any re-contact between the main body and the tension bar.

In this manner, the other end of the tension bar 271 is bonded to the front surface of the varistor main body, i.e., the front electrode plate and then the cover case is joined to the base case.

Now, a fourth embodiment of the present invention will be described in detail hereinafter with reference to FIGS. 11 to 14.

As shown in FIGS. 11 to 14, a varistor apparatus 300 includes: a base case 310 having an accommodating space formed therein, the base 310 having a bottom 315, lateral walls 311, 313 and 314 protrudingly formed from the edges thereof, a plurality of engagement members formed adjacent to the lateral walls and support members formed therein for preventing any movement of a varistor seated on the bottom 315; the varistor 360 mounted in the accommodating space inside the base case 310; a first withdrawn terminal plate 370 and a second withdrawn terminal plate 380 mounted at the external terminals of both sides of the varistor 360; a slider 390 for preventing any re-contact between the varistor 360 and the second withdrawn terminal plate 380 through insertion of the slider between the varistor 360 and the second withdrawn terminal plate 380 upon the separation of the second withdrawn terminal plate 380 from the contact terminal of the varistor 360 due to the overheating of the varistor 360; and a cover case 350 for covering the inner accommodating space of the base case so as to protect rotating parts for rotating the slider 390 and parts mounted inside the base case.

The cover case 350 has through-holes formed thereon so as to allow fastening members 341, 342 and 343 to be inserted thereto. The fastening members are inserted into engagement members of the base case 310. In this case, the fastening members may use a variety of fastening means such as flat screw, bolts, pins or the like.

The lateral wall 311 of the base case 310 has a viewing opening 303 formed thereon so as to check whether the slider 390 is in a still state or a rotated state. Also, the lateral wall 313 opposed to the lateral wall 311 formed with the viewing opening 303 has inserting grooves 321 and 322 formed thereon so as to allow the ends of the first withdrawn terminal plate 370 and the second withdrawn terminal plate 380 to be withdrawn to the outside therethrough and fit thereto. The height of the later wall between the inserting groove 321 and the inserting groove 322 is made lower than that of other portion of the lateral wall 313, and a support wall 323 is formed inwardly from the inserting groove 322 so as to support the second withdrawn terminal plate 380.

Also, the bottom 315 of the base case 310 has a rotary shaft formed thereon so as to rotate the slider.

In addition, the lateral wall 314 of base case 310 has an inserting groove formed thereon so as to allow an external socket connected to a withdrawn terminal 331 of a contact socket 330 to be inserted thereto. The lateral wall 312 has discharge apertures 317 and 319 formed at the bottom thereof in such a fashion as to be adjacent to one side of the lateral wall 313 and be in parallel with the bottom 315 so as to allow heat, gas or the like to be discharged to the outside therethrough. Also, a gap is defined between the lateral wall 313 and the cover case 350 so as to emit heat, gas or the like to the outside.

Further, the bottom 315 has inserting plates 316 and 317 vertically formed thereon so as to insert a PCB substrate 332 of the contact socket 330 thereto. The inserting plates 316 and 317 have slots formed thereon so as to fit the PCB substrate 332 thereto.

The PCB substrate 332 has a contact 333 mounted on a front surface thereof and the withdrawn terminal 331 mounted on a rear surface thereof. The contact 333 has a lug mounted thereon so that the lug is moved by rotation of the slider 390. The depression of the lug is converted into an electrical signal which is in turn applied to the withdrawn terminal 331. The PCB substrate 332 is formed with a contract structure that generates an electrical signal by movement of the lug of the contact 333 and a power supply.

By this configuration, when the slider 390 is rotated, whether the slider is rotated can be viewed from the outside through the viewing opening 303 as well as by means of an external circuit connected to the withdrawn terminal 331 from a remote place.

The varistor 360 internally includes a metal oxide and an internal terminal which are stacked on each other, and external terminals mounted at both sides thereof. The first withdrawn terminal plate 370 and the second withdrawn terminal plate 380 are bonded to the external terminals, respectively, by means of a bonding material. At this time, the melting point of a bonding material by which the first withdrawn terminal plate 370 and the external terminal are bonded to each other is made higher than that of a bonding material by which the second withdrawn terminal plate 380 and the external terminal are bonded to each other, so that when the varistor 360 is heated, the second withdrawn terminal plate 380 is earlier separated from the external terminal than the first withdrawn terminal plate 370. The bonding material by which the first withdrawn terminal plate 370 and the external terminal are bonded to each other preferably is lead having a melting point of 270° C. The bonding material by which the second withdrawn terminal plate 380 and the external terminal are bonded to each other preferably is a material in which impurities are added to the lead so as to have a melting point ranging from 100° C. to 200° C.

The first withdrawn terminal plate 370 is joined to the external terminal at the inside of the varistor 360 adjacent to the bottom 315 of the base case 310. In this case, the first withdrawn terminal plate 370 includes a withdrawn portion 371 which is inserted into the inserting groove 321 and is protruded to the outside of the base case 310, a support portion 372 bent from an inner end of the withdrawn portion 371, and a joining portion 373 protrudingly extending from the bottom surface of the support portion 372 toward the inner external terminal of the varistor 360. The joining portion 373 is joined to the inner external terminal of the varistor 360 by means of a bonding material.

The second withdrawn terminal plate 380 includes a withdrawn piece 381 and a joining piece 385. The withdrawn piece 381 includes a withdrawn portion 382 which is inserted into the inserting groove 322 and is protruded to the outside of the base case 310, a support portion 383 bent from an inner end of the withdrawn portion 382, and a projecting portion 384 protrudingly extending from a side of a top surface of the support portion 383. Also, the joining piece 385 includes a top plate portion 386 formed of a strip-type plate-shaped member which is welded at a bottom surface of one end thereof to the top surface of the projecting portion 384, a projecting portion 387 protrudingly extending from one side of the top plate portion 386 toward the bottom of the base case 310, a resilient portion 388 protrudingly extending from the other side of the top plate portion 386 toward the external terminal of the outer side of the varistor 360 in such a fashion as to be horizontally bent and inclined entirely so that a joining portion 389 can be joined to the external terminal of the varistor 360.

Also, the slider 390 is made of an insulating material such as synthetic resin, and has a plate shape which is interposed in a space defined by the top plate portion 386 and the resilient portion 388 of the second withdrawn terminal plate 380 and the outer surface of the varistor 360. The slider includes a base portion 393 formed in a generally 'L'-shape, a head portion 393 formed at a front end of the base portion 391. The base portion 391 has a through-hole 394 formed at a rear end thereof so as to allow the rotary shaft 325 to pass therethrough, and has a spring-fixing member 395 formed at a top surface adjacent to a side of the base portion 391 so as to allow a starting end of the spring 340 to be fit therearound. In this case, the terminating end of the spring 340 is fixed to the lateral wall 312 of the base case 310 or a support member 316 adjacent to the lateral wall 312.

In addition, the head portion 393 of the slider 390 is formed perpendicularly to the base portion 391 so as to be projected to both sides relative to the front end of the base portion 391. The head portion 393 has an identification sign indicated at a side thereof so as to identify whether the slider 390 is in a rotated state or in a normal or still state after separation of the second withdrawn terminal plate 380 from the external terminal at the outer surface of the varistor 360. The identification sign can be viewed from the outside through the viewing opening 303.

Figure 14:
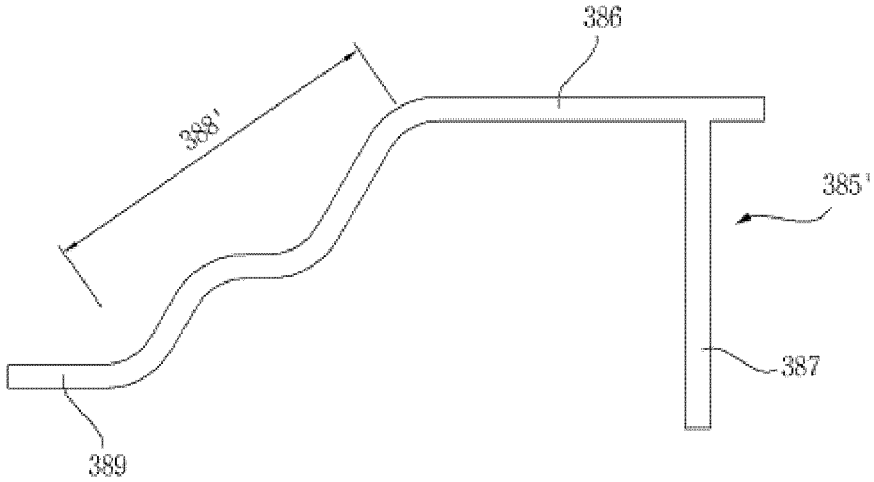
FIG. 14 is a front view illustrating another embodiment of a joining piece in the fourth embodiment of the present invention.

FIG. 14 is a front view of another embodiment of a joining piece of the present invention.

In case where the joining portion 389 of the second withdrawn terminal plate 380 is separated from the external terminal of the varistor 360, there exist a case where the temperature of the varistor is sharply raised by high instantaneous transient current and voltage and a case where the temperature of the varistor is gradually raised by low lasting transient current and voltage. In case where the joining portion 389 is separated from the external terminal of the varistor 360 by a gradual rise in temperature, sludge (residual) remains at the external terminal of the varistor 360, and hence the rotation of the slider 390 is hindered.

Figure 11:
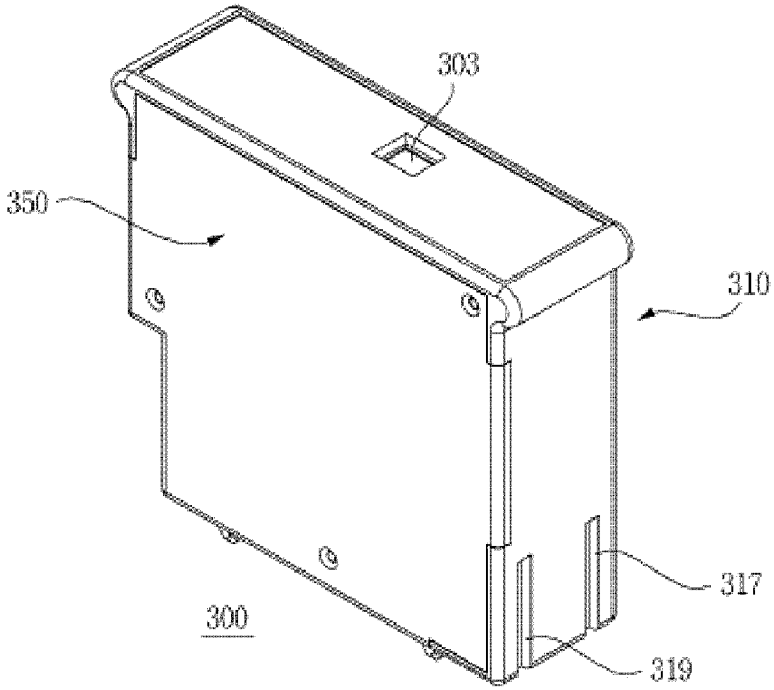
FIG. 11 is an exploded perspective view illustrating a fourth embodiment of the present invention.
Figure 12:
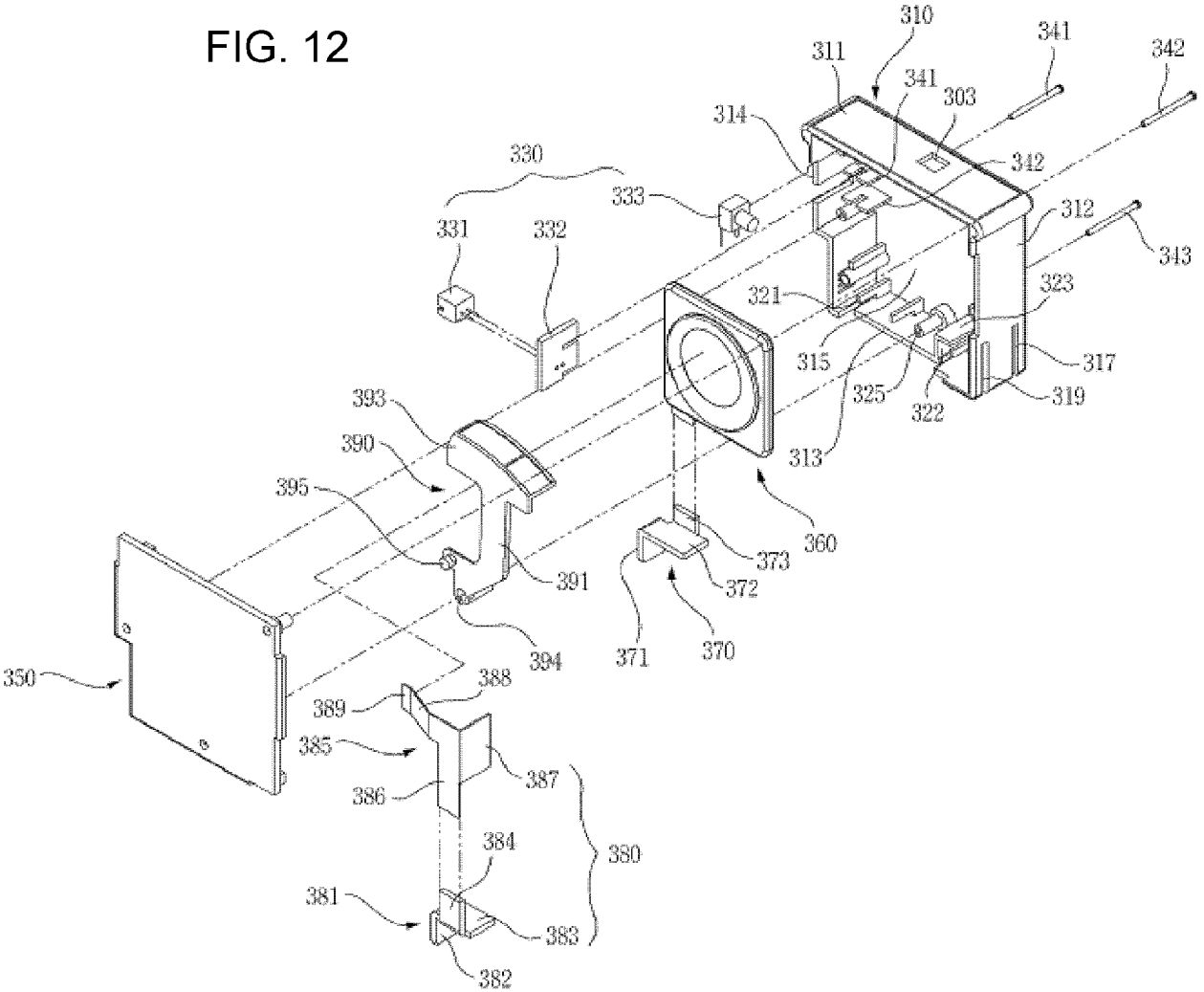
FIG. 12 is an exploded perspective view of FIG. 11.
Figure 13:
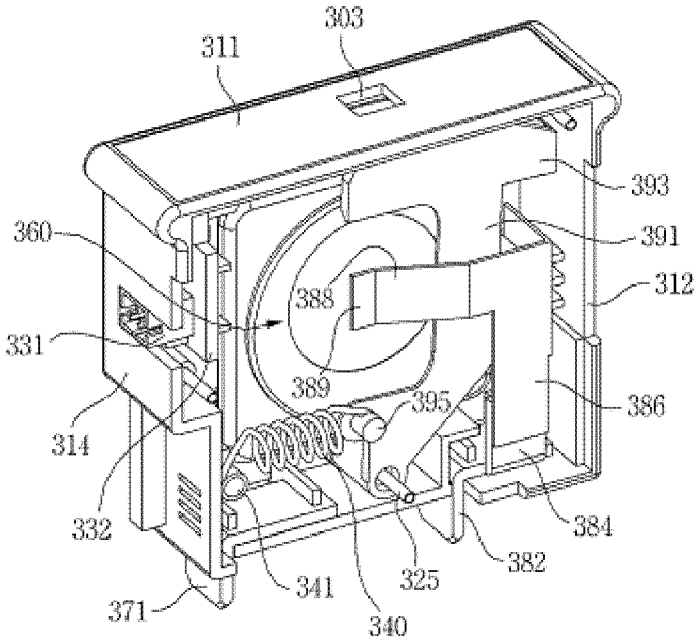
FIG. 13 is a perspective view illustrating a state where a second case is removed in the fourth embodiment of the present invention.

The joining piece 385' shown in FIG. 14 has the same structure as that of the joining piece 385 shown FIGS. 11 to 13 except the structure of the resilient portion 388.

The resilient portion 388' has a curved surface formed at a part thereof so as to allow the slider to easily pass through a portion to which sludge adheres upon the rotation of the slider 390. By such a structure in which the resilient portion 388' is formed with the curved surface, the slider 390 can be operated smoothly even in case where sludge remains at the external terminal of the varistor 360.

Now, the operation of the fourth embodiment of the present invention will be described hereainafter.

When overvoltage or overcurrent is introduced into the varistor 360 to cause the varistor to be overheated, since the melting point of a bonding material by which the second withdrawn terminal plate 380 and the external terminal at the outer surface of the varistor 360 are bonded to each other is lower than that of a bonding material by which the first withdrawn terminal plate 370 and the external terminal at the inner surface of the varistor 360 are bonded to each other, the second withdrawn terminal plate 380 is earlier separated from the external terminal of the varistor 360 than the first withdrawn terminal plate 370. Also, in this case, since the second withdrawn terminal plate 380 has a restoring force acting in an outward direction, i.e., in a direction of going far away from the bottom 315 of the base case 310, the resilient portion 388 and the joining portion 389 of the second withdrawn terminal plate 380 are separated from the outer surface of the varistor 360. When the resilient portion 388 and the joining portion 389 of the second withdrawn terminal plate 380 are spaced apart from the outer surface of the varistor 360, the spring-fixing member 395 is pulled by means of the restoring force of the spring 340 to cause the slider 390 to be rotated about the rotary shaft 325 and the head portion 393 of the slider 390 is rotated in a counterclockwise direction. In a state the slider 390 is rotated, since the base portion 391 is interposed between the joining portion 389 and the outer surface of the varistor 360, and is made of an insulating material, the second withdrawn terminal plate 380 and the outer surface of the varistor 360 are prevented from being short-circuited by any re-contact therebetween.

Further, when the slider 390 is rotated, the front end of the head portion 393 presses the lug of the contact 333 of the contact socket 330 to generate an electrical signal which in turns is applied to the withdrawn terminal 333. In this case, whether the slider 390 is rotated is also detected from a remote place by an electrical signal transmitted from the withdrawn terminal 333 to the outside.

Furthermore, when the slider 390 is rotated, the head portion 393 is also pivotally rotated to cause the identification sign formed at the both sides thereof to be viewed externally through the viewing opening 303.

As described above, according to the object and the construction of the present invention, the withdrawn terminal plate of the varistor is formed of a material having resiliency and the varistor external terminal and the joining portion are separated from each other by means of a restoring force upon the heating of the varistor, so that the withdrawn terminal plate and the external terminal of the varistor are sufficiently spaced apart from each other even upon the introduction of a surge of more than a threshold current capacity to thereby prevent short-circuiting accident.

In addition, when the withdrawn terminal plate and the external terminal of the varistor is separated from each other, the slider is caused to be interposed between the joining portion and the outer surface of the varistor to thereby prevent any re-contact between the withdrawn terminal plate and the external terminal of the varistor.

Moreover, since the slider turns the LED installed on the housing on while being moved, the operation state of the varistor can be easily checked from the outside.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A varistor apparatus comprising:

a base case including a bottom and lateral walls bent upwardly from the edges of the bottom;

a varistor including a main body, a front electrode plate welded to a front surface of the main body, and a rear electrode plate welded to a rear surface of the main body, the rear electrode plate being disposed adjacent to the bottom of the base case;

a front terminal member projected at one end thereof to the outside of the base case and disposed at the other end thereof inside the base case;

a rear terminal member projected at one end thereof to the outside of the base case and disposed at the other end thereof inside the base case so as to joined to the rear electrode plate;

a tension bar joined at one end thereof to the other end of the front terminal member and thermally welded at the other end thereof to the front electrode plate, the tension bar having a restoring force for allowing the other end of the tension bar to be far away from the front electrode plate; and a cover case joined to the base case.

2. The varistor apparatus according to claim 1, wherein the bottom has inner support walls protrudingly formed concentrically thereon so as to allow the rear surface of the varistor to be seated on the top surface thereof.

3. The varistor apparatus according to claim 1, wherein the varistor is formed in a disc shape, the bottom has a plurality of fixing portions formed concentrically thereon so as to allow the inner circumference thereof to abut against the outer circumference of the varistor, the fixing portions being formed with resilient members having retaining steps retained on the top surface of the varistor main body.

4. The varistor apparatus according to claim 1, wherein the front electrode plate is formed in a disc shape and has a plurality of through-holes formed thereon.

5. The varistor apparatus according to claim 1, wherein the rear electrode plate is formed in a disc shape and includes a metal plate having a plurality of through-holes formed thereon and a bent portion bent integrally from a part of the circumferential surface of the metal plate, the bent portion being screw-engaged with the rear terminal member.

6. The varistor apparatus according to claim 1, wherein the other end of the tension bar is bonded to the front electrode plate by means of a bonding material having a low melting point, and the melting point of the bonding material having the low melting point is lower than that of a bonding material by which the rear electrode plate and the rear surface of the main body are bonded to each other.

7. The varistor apparatus according to claim 1, wherein the joined portion between one end of the tension bar and the front terminal member is higher than the front surface of the varistor main body.

8. A varistor apparatus comprising:

a housing;

a varistor accommodated in the housing;

a first withdrawn terminal plate joined at one end thereof to one side of the varistor by means of a first bonding material having a first melting point;

a second withdrawn terminal plate joined at one end thereof to the other side of the varistor by means of a second bonding material having a second melting point lower than the first melting point, wherein the first withdrawn terminal plate and the second withdrawn terminal plate are projected at the other ends thereof to the outside of the housing, and the second withdrawn terminal plate includes a resilient portion formed inclinedly between the one end and the other end thereof having a restoring force acting in a direction of going far away from the other side of the varistor;

a slider fit at one end thereof to a rotary shaft protruded from the inside of the housing so as to be rotated about the rotary shaft, the slider having a base portion inserted in a space defined by the other side of the varistor and the second withdrawn terminal plate; and a spring connected at a starting end to the slider and connected at a terminating end to the housing in such a fashion as to have a restoring force so as to be compressed, whereby when the one end of the second withdrawn terminal plate is separated from the other side of the varistor, the slider is rotated by means of the restoring force of the spring to cause the slider to be interposed between the one end of the second withdrawn terminal plate and the other side of the varistor to thereby prevent a short-circuiting.

9. The varistor apparatus according to claim 8, wherein the base portion of the slider has a head portion projecting in a lengthwise direction thereof, and the housing has a contact and a withdrawn terminal mounted therein, the contact being adapted to be switched on or off by the rotation of the head portion and the withdrawn terminal being adapted to transfer the switching state of the contact to the outside.

10. The varistor apparatus generator according to claim 9, wherein the housing has a viewing opening formed thereon, the head portion of the slider has identification sign indicated at a side thereof so as to identify the rotation state of the slider so that the identification sign can be viewed from the outside through the viewing opening.

11. The varistor apparatus according to claim 8, wherein the second withdrawn terminal plate comprises a withdrawn piece and a joining piece, wherein the withdrawn piece includes a withdrawn portion which is inserted into the inserting groove formed in the housing and is protruded to the outside of the housing, a support portion bent from an inner end of the withdrawn portion, and a projecting portion protrudingly extending from a side of a top surface of the support portion, and wherein the joining piece includes a top plate portion formed of a strip-type plate-shaped member which is welded at a bottom surface of one end thereof to the top surface of the projecting portion, and a resilient portion made of a resilient member protrudingly extending from the other side of the top plate portion toward the other side of the varistor in such a fashion as to be horizontally bent and inclined entirely so that a joining portion can be joined to the other side of the varistor.

12. The varistor apparatus according to claim 11, wherein the resilient portion has a curved surface formed thereon.

* * * * *